US005419258A

United States Patent [19]

Peters

[11] Patent Number: 5,419,258

[45] Date of Patent: May 30, 1995

[54] STEEL PROPELLANT CASING

[75] Inventor: René Peters, 's-Hertogenbosch, Netherlands

[73] Assignee: NWM de Kruithoorn B.V., 's-Hertogenbosch, Netherlands

[21] Appl. No.: 112,073

[22] Filed: Aug. 26, 1993

[30] Foreign Application Priority Data

Aug. 26, 1992 [DE] Germany ..... 42 28 302.7

[51] Int. Cl.[6] ..... F42B 5/28

[52] U.S. Cl. ..... 102/468

[58] Field of Search ..... 102/464, 468; 29/1.3, 29/1.32

[56] References Cited

U.S. PATENT DOCUMENTS 2,402,068 6/1946 Meador .
2,736,085 2/1956 Parre et al. ..... 29/13
2,915,424 12/1959 Lyon .
3,058,195 10/1962 Ericsson .
3,797,396 3/1974 Reed ..... 102/464
4,418,607 12/1983 Price .

FOREIGN PATENT DOCUMENTS 096186 12/1983 European Pat. Off. .
764951 5/1934 France .
503966 4/1971 Switzerland .
574877 1/1946 United Kingdom ..... 102/468

*Primary Examiner*—Harold J. Tudor
*Attorney, Agent, or Firm*—Spencer, Frank & Schneider

[57] ABSTRACT

A steel propellant casing includes a substantially cylindrical casing body provided with a casing bottom at one end thereof and with a shoulder cone at an opposite end thereof. The shoulder cone terminates in a casing neck, and has an essentially uniform wall thickness. The shoulder cone wall thickness is, within a range of up to several tenths of a millimeter, less than the wall thickness of the casing body adjacent the shoulder cone between the shoulder cone and the casing bottom.

2 Claims, 1 Drawing Sheet

CASING STEEL PROPELLANT

BACKGROUND OF THE INVENTION

The present invention relates to propellant casings including a substantially cylindrical casing body provided at one end thereof with a casing bottom and at another end thereof with a shoulder cone which terminates in a casing neck and which has an essentially uniform wall thickness. The present invention further relates to a method of making such propellant casings by drawing, from a steel blank, a preliminary cylindrical body with bottom, and subsequently shaping the casing bottom and the cylindrical casing body, and die-sinking the shoulder cone and the casing neck.

Propellant casings made of steel or weight-saving aluminum are well known. Reduction of ammunition weight has also been accomplished by producing steel propellant casings such that casing wall thicknesses are maintained at a minimum, particularly if the ammunition is to be transported by air.

For example, U.S. Pat. No. 2,915,424 discloses a method of making a propellant casing which involves the steps of coining a polygonal steel blank into a cup shaped piece, and subsequently deep drawing the piece through a series of successive annealing and drawing stages, after which the bottom and the neck of the casing are formed. Except for the regions adjacent the bottom of the casing, the cylindrical casing body, up to the front end of the casing neck, has a resulting wall thickness which is uniform.

Swiss Patent No. 503,966 discloses aluminum propellant casings that are produced from a cylindrical blank. The blank is reshaped into a cup-shaped piece before being deep-drawn. The casing bottom and the casing neck connected with the cylindrical casing body by the shoulder cone are shaped thereafter. The wall thickness is either uniform or decreases continuously from the casing bottom to the front region of the casing, and is enlarged in the region of the shoulder cone and the casing neck. The difference in thicknesses is due to the upsetting occurring during the formation of the cone and neck regions.

European Patent No. 0,096,186 discloses a steel propellant casing in which the wall thickness, which continuously decreases from the casing bottom toward the front of the casing, is increased in the region of the shoulder cone before the latter is formed. As a result, the wall thickness in the region of the shoulder cone will be uniform in the completed propellant casing. This measure seeks to avoid buckling in the region of the shoulder cone during loading of the cartridge into the weapon.

When conventional ammunition having steel propellant casings is fired, for example, from an automatic cannon having a rotary breechblock, as disclosed, for example, in U.S. Pat. No. 4,418,607, it has been found that frequent jamming of the breechblock and malfunctions during unloading of the weapon tend to occur.

SUMMARY OF THE INVENTION

It is an object of the present invention to provide a propellant casing with which jamming of the breechblock and malfunctions during unloading of the weapon are avoided.

This is accomplished according to the invention by providing the propellant casing with a shoulder cone whose wall thickness is reduced with respect to the wall thickness of the cylindrical casing body at regions adjacent the shoulder cone by an amount within a range of up to several tenths of a millimeter. When such a shoulder cone is provided, the mentioned complications associated with the prior art are surprisingly no longer observed. Presumably, the prior complications were caused by the fact that the gas pressure from firing following the axial widening of about 0.15 mm of the axial breechblock movement caused the propellant casing to be widened in the charge chamber not only radially but also axially. The propellant casing would thus be plastically deformed—if only slightly—and therefore become incapable of complete spring-back. A frictional engagement would thus be generated between breechblock and casing bottom which could then cause the jamming of the breechblock. In this connection, a tapering of the shoulder cone forming the transition region of the propellant casing according to the present invention provides for a sufficient elastic spring-back of the propellant casing during firing, thus enabling the breechblock to perform its axial spring-back, and hence reducing to a minimum the risk of jamming due to the friction between the breechblock and the casing bottom during the opening movement of the breechblock so that the breech can be opened with ease.

DESCRIPTION OF THE PREFERRED EMBODIMENT

Figure 1:
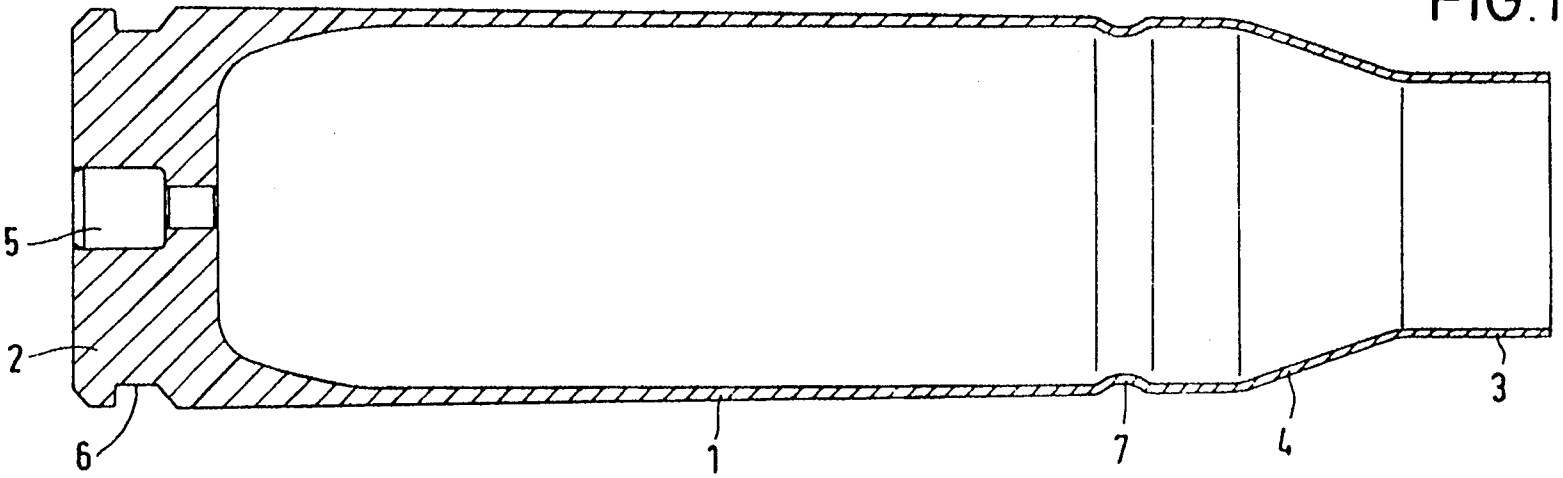
FIG. 1 is an axial sectional view of a propellant casing incorporating the invention.
Figure 2:
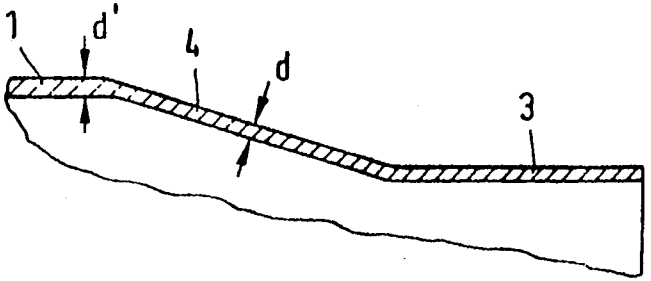
FIG. 2 is an enlarged sectional view of one part of the propellant casing of FIG. 1.

The one-piece steel propellant casing shown in FIG. 1 includes a casing body 1 which is provided at its one end with a casing bottom 2 and at its other end with a shoulder cone 4 terminating in a casing neck 3, the latter having a diameter that is smaller than that of casing body 1. Casing bottom 2 is provided with a central opening 5 to accommodate a primer and also has a circumferential recess 6. Casing body 1 is provided with a circumferential groove 7 disposed at a relatively short distance rearwardly of shoulder cone 4. The wall thickness of casing body 1 decreases continuously from the region of casing bottom 2 to shoulder cone 4, for example, from 1.4 mm to 0.9 mm. Such propellant casings are employed, for example, for calibers from 25 mm to 35 mm or more.

The shoulder cone 4 has a wall thickness d which is reduced by an amount within a range of up to several tenths of a millimeter, preferably from 0.05 mm to 0.4 mm, and particularly from 0.01 to 0.2 mm, with respect to the wall thickness d' of the adjacent region of casing body 1, which is, for example, 0.9 mm. By virtue of such a wall thickness reduction the shoulder cone region is given greater elasticity.

Figure 3:
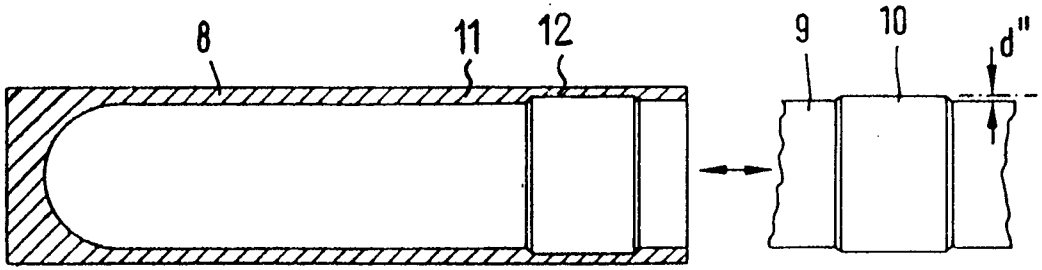
FIG. 3 is a partially sectional, fragmentary side elevational view of a propellant casing blank and tool, illustrating part of a manufacturing step in the production of the propellant casing of FIG. 1.

The propellant casing of the present invention is produced according to the following method:

A steel blank is initially used to draw a preliminary cylindrical body 8, as seen in FIG. 3. During drawing of preliminary cylindrical body 8, a draw mandrel 9 having a bead 10 is employed such that first and second cylindrical portions 11 and 12 are formed on body 8. The bead 10 causes the wall thickness of second cylindrical portion 12 to be reduced with respect to the wall thickness of the first cylindrical portion 11 adjacent portion 12 by an amount d″. Amount d″ corresponds to the distance by which bead 10 projects radially over the outer diameter of draw mandrel 9, and is within a range of up to several tenths of a millimeter. After the cylindrical portion 12 is formed, the mandrel 9 is withdrawn from body 8. Due to the inherent elasticity of the thin walls of the body 8, such a withdrawal is readily feasible and is thus not obstructed by the bead 10, whose diameter is necessarily greater than the inner diameter of the body portion in the zone of its open end.

Second cylindrical portion 12 is thereafter formed into the shoulder cone 4, for example by extruding preliminary cylindrical body 8 through one or a series of extrusion presses as is well known in the art. Shaping the casing bottom 2 involves process steps which are conventional as well.

Draw mandrel 9 causes the wall thickness of second cylindrical portion 12 to be reduced with respect to the wall thickness of first cylindrical portion 11 such that during forming of the shoulder cone, the latter is provided with an uniform wall thickness which is reduced with respect to the casing body wall thickness, in spite of the upsetting that occurs during this forming process.

Having described the invention, it will be apparent to those skilled in the art that various modifications may be made thereto without departing from the spirit of this invention and the scope of the appended claims.

What is claimed:

1. In a steel propellant casing including a casing body having a casing body wall thickness and being provided with a casing bottom at one end thereof and with a shoulder cone at an opposite end thereof; said shoulder cone terminating in a casing neck and having an essentially uniform shoulder cone wall thickness; the improvement wherein said shoulder cone wall thickness is, within a range of between about 0.01 to 0.4 mm, less than said casing body wall thickness adjacent said shoulder cone between said shoulder cone and said casing bottom.

2. The propellant casing as defined in claim 1, wherein said range is between about 0.01 to 0.2 mm.

* * * * *